US007929005B2

(12) United States Patent
Hirai et al.

(10) Patent No.: US 7,929,005 B2
(45) Date of Patent: Apr. 19, 2011

(54) THERMAL PRINTER

(75) Inventors: Kimitaka Hirai, Chiba (JP); Hideki Watanabe, Chiba (JP); Akio Naito, Chiba (JP)

(73) Assignee: Seiko Instruments Inc. (JP)

( * ) Notice: Subject to any disclaimer, the term of this patent is extended or adjusted under 35 U.S.C. 154(b) by 716 days.

(21) Appl. No.: 11/906,843

(22) Filed: Oct. 4, 2007

(65) Prior Publication Data

US 2008/0088692 A1 Apr. 17, 2008

(30) Foreign Application Priority Data

Oct. 17, 2006 (JP) ..... 2006-282983

(51) Int. Cl.
*B41J 2/335* (2006.01)

(52) U.S. Cl. ..... 347/198; 347/197; 347/215; 347/220

(58) Field of Classification Search ..... 347/197, 347/198, 215–218, 220, 222
See application file for complete search history.

(56) References Cited

U.S. PATENT DOCUMENTS

| | | | | |
|---|---|---|---|---|
| 5,063,395 | A * | 11/1991 | Nuita et al. | 347/220 |
| 5,447,380 | A | 9/1995 | Colonel et al. | 400/120.01 |
| 5,579,043 | A * | 11/1996 | Patry | 347/222 |
| 5,694,159 | A | 12/1997 | Kajiya et al. | 347/197 |
| 7,001,089 | B2 * | 2/2006 | Tozaki et al. | 400/708 |
| 7,614,809 | B2 * | 11/2009 | Kaiya | 400/120.16 |
| 7,780,367 | B2 * | 8/2010 | Yoshioka | 400/120.16 |
| 2003/0076401 | A1 | 4/2003 | Mori et al. | 347/215 |

* cited by examiner

*Primary Examiner* — Daniel Petkovsek
(74) *Attorney, Agent, or Firm* — Adams & Wilks

(57) ABSTRACT

A thermal printer has a thermal head mounted on a case main body and a platen roller confronting the thermal head. A cover member mounted to the case main body undergoes swinging movement to open and close an opening of the case main body. A slider rotatably supports the platen roller and is mounted to the cover member for linear movement on a plane including a rotational center of the platen roller and a swing center of the cover member. Engagement pieces mounted to the slider engage with engagement portions of the case main body when the cover member closes the opening of the case main body and the platen roller confronts the thermal head. A biasing member biases the slider such that the engagement pieces engage with the engagement portions of the case main body and the platen roller is brought into pressure contact with the thermal head.

4 Claims, 4 Drawing Sheets

THERMAL PRINTER

BACKGROUND OF THE INVENTION

1. Field of the Invention

The present invention relates to a thermal printer.

2. Description of the Related Art

As a conventional thermal printer, there is one disclosed in, for example, Patent Document 1.

In the thermal printer disclosed in Patent Document 1 (JP 2000-318260 A), a pressure spring is disposed between a back surface of a thermal head and a lock arm for supporting a platen roller disposed so as to oppose to a printing surface side of the thermal head. Due to a biasing force of the pressure spring, the platen roller and the thermal head come into close contact with each other by a predetermined pressurizing force.

In the thermal printer described in Patent Document 1, in a case where heat sensitive paper is jammed between the platen roller and the thermal head or the like, it is necessary to swing the lock arm to cause the platen roller and the thermal head to be spaced apart from each other. Herein, the lock arm is allowed to swing to cause the platen roller and the thermal head to be spaced apart largely from each other, so the jammed heat sensitive paper can be readily removed. In addition, after the jammed paper is completely removed, due to the biasing force of the pressure spring, the platen roller and the thermal head can be returned to original positions thereof.

According to the thermal printer, the pressure spring is shared as a pressure spring for pressing the platen roller and the thermal head by the predetermined pressurizing force so as to come into close contact with each other and as a pressure spring for restoring the lock arm swinging. Thus, components can be reduced in number and cost can be reduced, which are advantageous.

However, in the thermal printer described in Patent Document 1, because the pressure spring effectively applies its pressurizing force to the thermal head, it is preferable that the pressure spring be disposed on an extended line connecting a contact position of the thermal head and the platen roller and an axial center of the platen roller. Accordingly, a position of the pressure spring is distant from a swing center of the lock arm, which is inconvenient. That is, a stroke of the pressure spring becomes large to secure a sufficient swing range of the lock arm, which is inconvenient.

In the case where the stroke of the pressure spring is large, a space in which the pressure spring having the large stroke and a portion of the lock arm are disposed is necessary to be defined at the back surface side of the thermal head. Thus, there arises a problem in that the back surface side of the thermal head cannot be made compact.

SUMMARY OF THE INVENTION

The present invention has been made in view of the above-mentioned circumferences, and therefore it is an object of the present invention to provide a thermal printer in which a space in a back surface side of a thermal head can be made smaller, an entire width dimension can be reduced, and heat sensitive paper is sandwiched between the thermal head and a platen roller with a sufficient pressurizing force, to perform clear printing.

In order to attain the above-mentioned object, the present invention provides the following means.

The present invention provides a thermal printer including a case main body; a thermal head fixed to a side wall of the case main body; a platen roller disposed so as to oppose to a printing surface of the thermal head, for feeding heat sensitive paper while sandwiching the heat sensitive paper with the thermal head; and biasing means for biasing the platen roller to a side of the thermal head.

According to the present invention, by fixing the thermal head to the side wall of the case main body, a provision space of the pressure spring in the back surface side of the thermal head can be eliminated, and a width dimension thereof can be reduced. Further, by fixing the thermal head to the side surface of the case main body, rigidity of the thermal head can be reinforced due to the case main body. Thus, the thermal head can be thinner, and the width dimension can be further reduced.

In the above-mentioned invention, a swing arm swingably mounted to the case main body, and a slider mounted to a front end of the swing arm so as to be capable of moving on a plane including a rotational center of the platen roller and a swing center of the swing arm, for rotatably supporting the platen roller may be provided, and the biasing means may bias the slider in an outward direction of a swing radius direction of the swing arm.

As structured above, the slider mounted with the platen roller is biased in the outward direction of the swing direction at a front end portion of the swing arm due to a biasing force of the biasing means, so heat sensitive paper can be pressurized while being sandwiched between the platen roller and the thermal head disposed so as to oppose to the platen roller. In this case, the slider is caused to move on the plane including the rotational center of the platen roller and the swing center of the swing arm, so the biasing force of the biasing means is not consumed as a moment for causing the swing arm to swing, but the entire biasing force is used as the pressurizing force to the thermal head and the platen roller. As a result, the heat sensitive paper is effectively pressurized to the printing surface of the thermal head, thereby performing clear printing.

Meanwhile, by causing the slider to move in the inward direction of the swing radius direction at the front end portion of the swing arm, the platen roller is caused to be spaced apart from the printing surface of the thermal head. By causing the swing arm to swing in this state, a space is sufficiently defined between the platen roller and the thermal head, so a supplying operation of the heat sensitive paper can be facilitated.

In the above-mentioned invention, an engagement piece fixed to the slider, and an engagement member provided to the case main body, for causing the engagement piece to be engaged therewith at a position where the platen roller opposes to the printing surface of the thermal head to engage the swing arm swinging, may be provided.

As structured above, the engagement piece fixed to the slider can be caused to engage with the engagement member provided to the case main body, and the swing arm can be fixed to the case main body without swinging. Accordingly, the platen roller is biased to the thermal head side due to the biasing force of the biasing means at the position where the platen roller opposes to the printing surface of the thermal head, to thereby continuously pressurize the heat sensitive paper.

Further, in the above-mentioned invention, the swing arm may be provided with a lever for causing the slider to move in an inward direction of the swing radius direction against a biasing force of the biasing means.

As structured above, when the lever is operated to cause the slider to move in the inward direction of the swing radius direction, an engagement state of the engagement piece and the engagement member is readily released, and the swing arm can be allowed to swing.

Further, in the above-mentioned invention, the case main body may be structured to have a rectangular-parallelepiped box shape, and provided with a storing portion for storing a roll-shaped heat sensitive paper, and the thermal head may be fixed to a side wall in an upper portion of the storing portion.

As structured above, the thermal head, the platen roller, and the biasing means can be disposed to a dead space defined between the rectangular-parallelepiped box-shaped case main body and the roll-shaped heat sensitive paper in a state where the roll-shaped heat sensitive paper is stored in the storing portion of the case main body, so the space is effectively used and the case main body can be made compact.

Further, in the above-mentioned invention, the swing arm may structure an upper portion cover of the storing portion.

As structured above, the swing arm is caused to swing to cause the platen roller to be spaced apart from the printing surface of the thermal head, and at the same time the storing portion for storing the roll-shaped heat sensitive paper can be released. As a result, a recovering operation of a paper jam or the supplying operation of the heat sensitive paper can be executed rapidly.

According to the present invention, the back surface side of the thermal head is attained to be made compact, the entire width dimension is reduced, and the heat sensitive paper is sandwiched between the thermal head and the platen roller with the sufficient pressurizing force, to perform clear printing, which are effective.

DETAILED DESCRIPTION OF THE PREFERRED EMBODIMENT

Referring to FIGS. 1 to 7, a thermal printer 1 according to an embodiment of the present invention will be described hereinafter.

Figure 1:
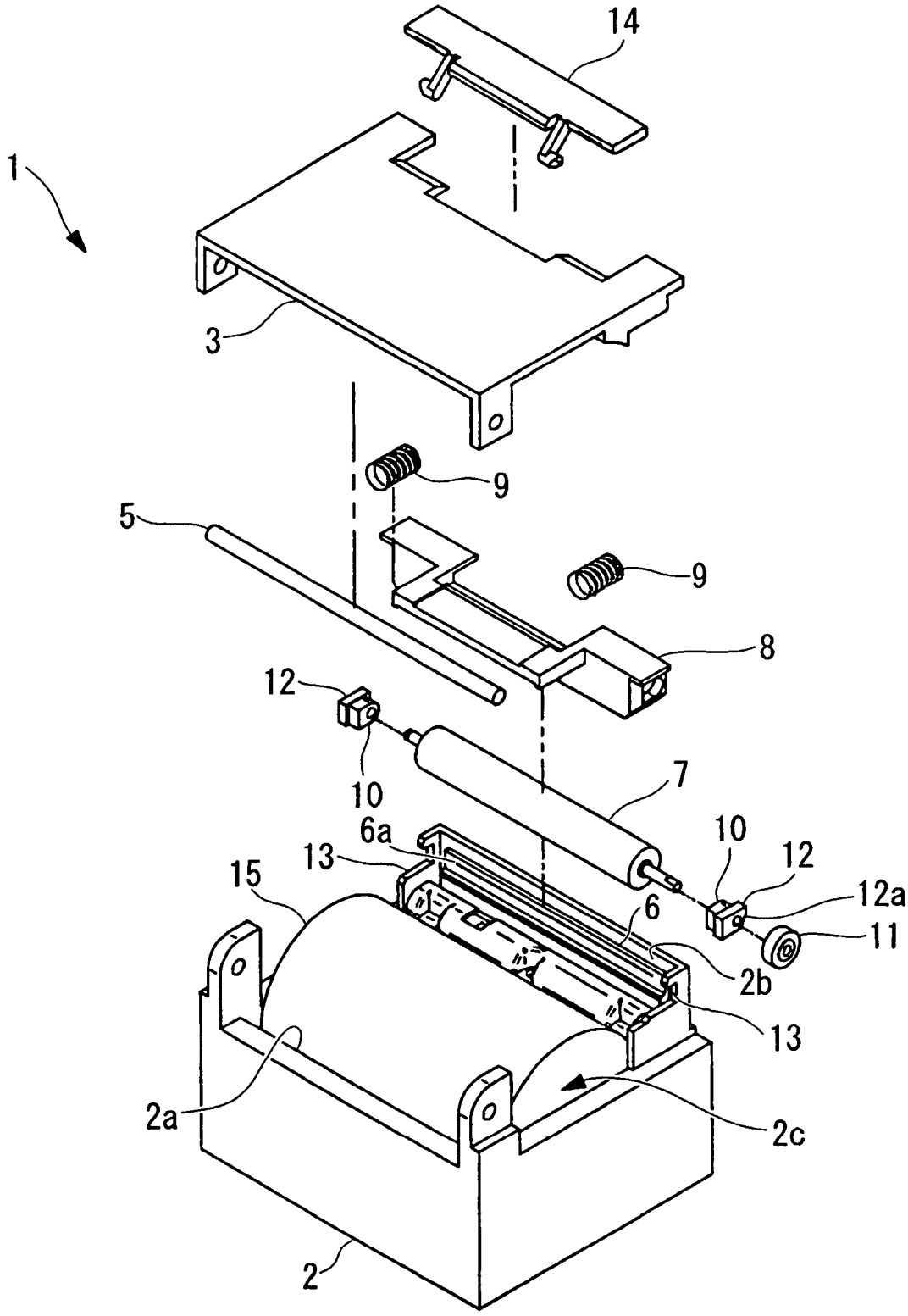
FIG. 1 is an exploded perspective view showing a thermal printer according to an embodiment of the present invention.
Figure 2:
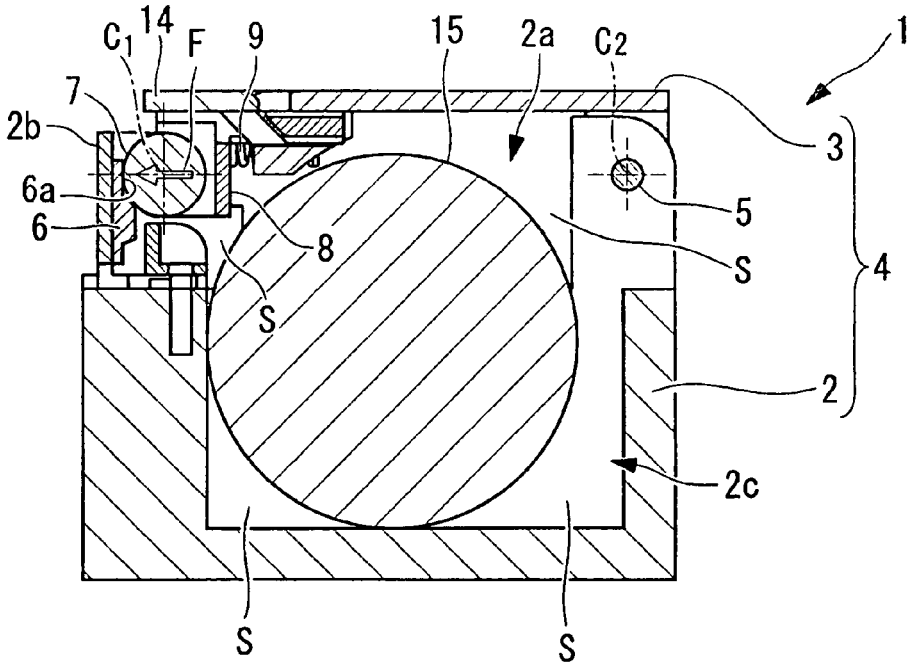
FIG. 2 is a longitudinal sectional view showing a relation of a slider and a lever member of the thermal printer shown in FIG. 1.
Figure 3:
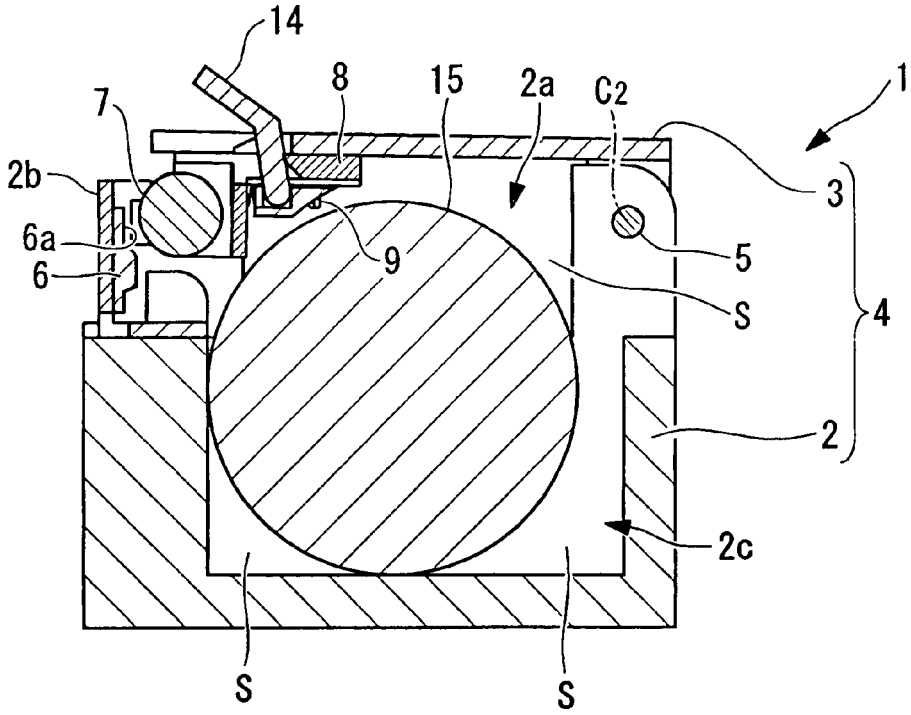
FIG. 3 is a longitudinal sectional view showing the thermal printer in a state where the lever member is caused to swing from the state shown in FIG. 2.

As shown in FIGS. 1 to 3, the thermal printer 1 of the embodiment includes a substantially rectangular-parallelepiped box-shaped case 4 including a box-shaped case main body 2 having an upper portion opening 2*a*, and a cover member (swing arm) 3 swingably mounted to the case main body 2 via a shaft 5 and being capable of opening/closing the upper portion opening 2*a* of the case main body 2. The case main body 2 is provided with a storing portion 2*c* for storing roll-shaped heat sensitive paper 15.

A substantially flat-plate-shaped thermal head 6 is directly fixed to a side wall 2*b* in an upper portion of the case main body 2. Further, in the vicinity of a swing end of the cover member 3, a platen roller 7, which opposes to a printing surface 6*a* of the thermal head 6 when the cover member 3 is closed, is mounted.

In the vicinity of the swing end of the cover member 3, a slider 8, which is supported so as to be capable of linearly moving in a swing radius direction of the cover member 3, is provided. Coil springs 9 are disposed between the slider 8 and the cover member 3, and the slider 8 is continuously biased in an outward direction of the swing radius direction.

The platen roller 7 is rotatably supported by the slider 8 via shaft bearings 10. Then, the slider 8 is caused to linearly move in the swing radius direction, whereby the platen roller 7 is caused to linearly move on a plane including a rotational center C1 thereof and a swing center C2 of the cover member 3. In FIG. 1, reference numeral 11 represents a gear for transmitting a rotational force to the platen roller 7.

Figure 4:
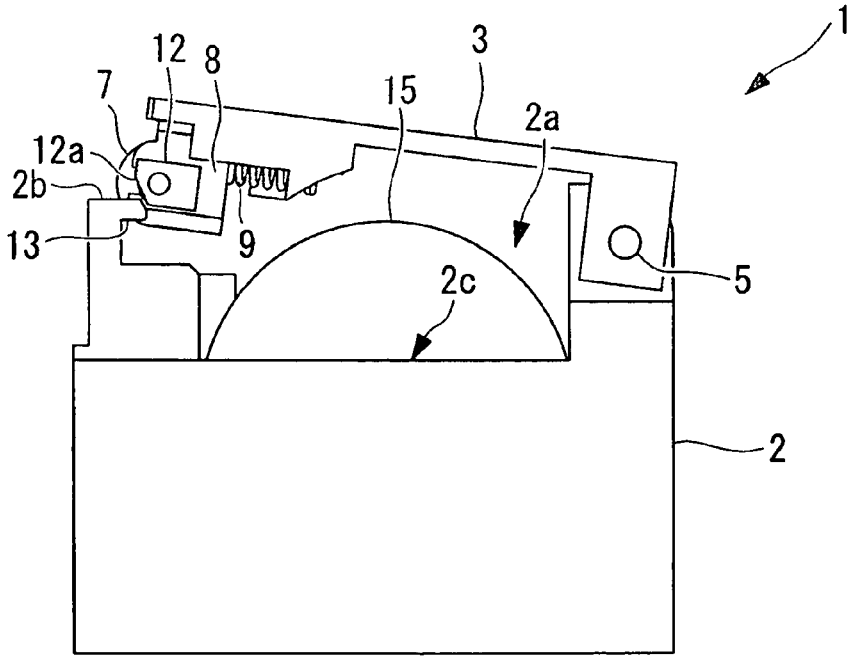
FIG. 4 is s diagram showing a relation of engagement pieces and engagement concave portions of the thermal printer shown in FIG. 1.
Figure 5:
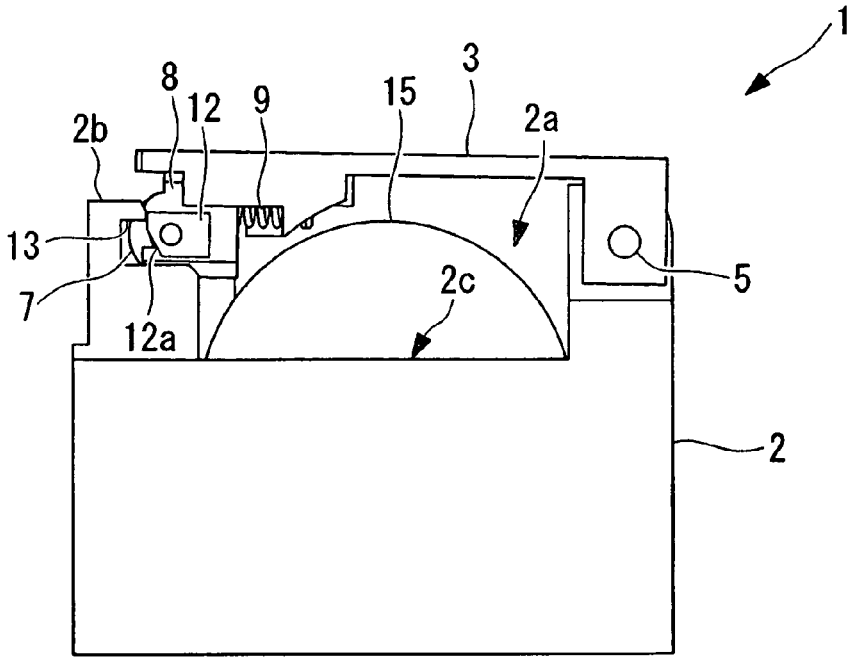
FIG. 5 is a diagram showing a state immediately before the engagement pieces and the engagement concave portions are engaged from the state shown in FIG. 4.

Further, as shown in FIGS. 1 and 4 to 7, engagement pieces 12 are fixed to both ends of the slider 8 in a width direction thereof. In the meantime, at positions of the case main body 2 in a width direction thereof corresponding to the engagement pieces 12, engagement concave portions (engagement members) 13 for engaging the engagement pieces 12 fixed to the slider 8 are provided. Each of the engagement pieces 12 includes a chamfer 12*a*. In a case where the engagement pieces 12 are engaged with the engagement concave portions 13, as shown in FIGS. 4 and 5, the chamfers 12*a* function as cams for causing the slider 8 to move.

Figure 6:
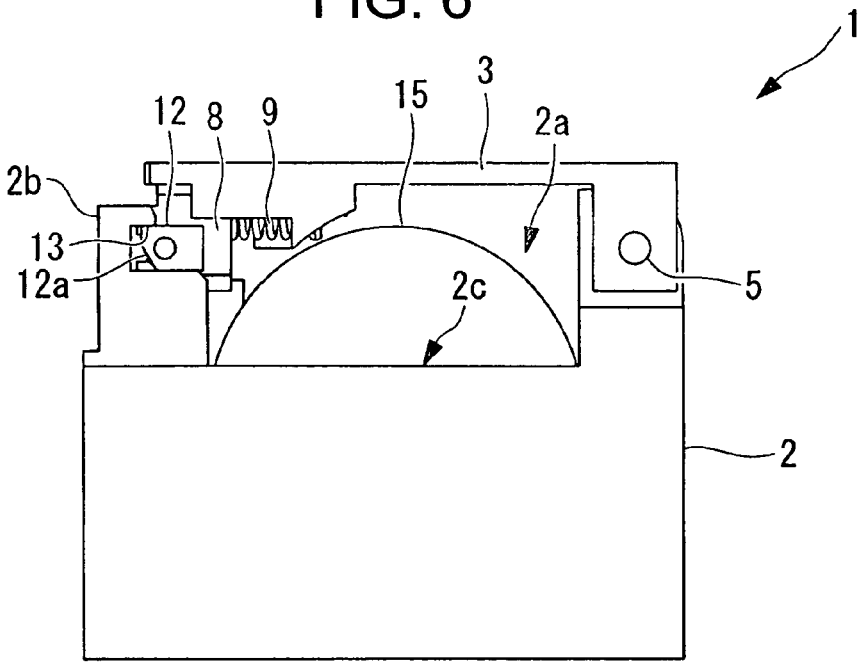
FIG. 6 is a diagram showing a state where the engagement pieces and the engagement concave portions are engaged from the state shown in FIG. 5.

By swinging the cover member 3 from a state shown in FIG. 4 to a state shown in FIG. 5, the engagement pieces 12 come to mount onto the case main body 2 by means of the chamfers 12*a*, whereby the slider 8 is caused to move in an inward direction of the swing radius direction of the cover member 3. Then, the engagement pieces 12 and the concave portions 13 cause the cover member 3 to swing, and are engaged with each other as shown in FIG. 6 due to the fact that the slider 8 is pushed in the outward direction of the swing radius direction in a state where the platen roller 7 is disposed at a position where the platen roller 7 opposes to the printing surface 6*a* of the thermal head 6, whereby engaging the cover member 3 swinging.

In this case, in the state where the engagement pieces 12 are engaged with the concave portions 13, the cover member 3 closes the upper portion opening 2*a* of the case main body 2, and due to a biasing force F of the coil springs 9, the platen roller 7 is caused to pressurize the printing surface 6*a* of the thermal head 6.

Figure 7:
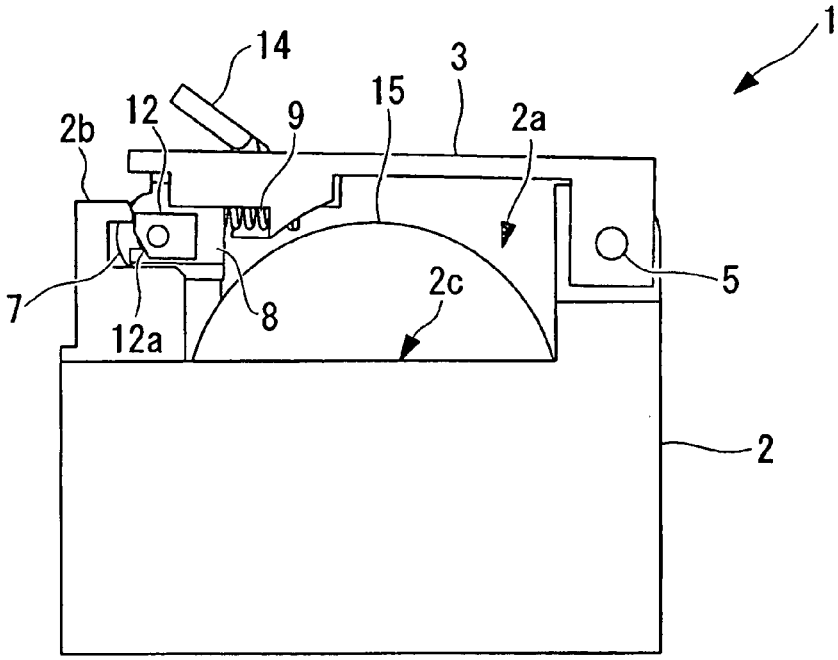
FIG. 7 is a diagram showing a state where the engagement of the engagement pieces and the engagement concave portions is released from the state shown in FIG. 6.

Further, as shown in FIGS. 2, 3, and 7, a lever member 14 operated by an operator is swingably mounted to the cover member 3. The lever member 14 is operated in a case of opening the cover member 3 with respect to the case main body 2, whereby the slider 8 can be caused to linearly move in the inward direction of the swing radius direction of the cover member 3 while the coil springs 9 are compressed, due to the principle of leverage in which the swing center serves as a fulcrum and a contact point of the slider 8 and the lever member 14 serves as an action point.

An action of the thermal printer 1 as structured above according to the embodiment will be described below.

According to the thermal printer 1 of the embodiment, in a case of setting the heat sensitive paper 15 between the thermal head 6 and the platen roller 7, the operator operates the lever member 14 mounted to the cover member 3, opens the cover member 3 swinging as shown in FIG. 3, and stores the roll-shaped heat sensitive paper 15 in the storing portion 2*c* provided to the case main body 2.

In this case, in a case of applying an external force with respect to the lever member 14, the lever member 14 is caused to swing with respect to the cover member 3, and the coil springs 9 are compressed by a small force to cause the slider 8 to move in the inward direction of the swing radius direction of the cover member 3 due to the principle of leverage. Accordingly, the platen roller 7 mounted to the slider 8 is caused to be spaced apart from the thermal head 6, and the engagement state of the engagement pieces 12 fixed to the slider 8 and the engagement concave portions 13 provided to the case main body 2 is released, so the cover member 3 is capable of swinging with respect to the case main body 2.

Further, by causing the cover member 3 to swing with respect to the case main body 2, the platen roller 7 mounted to the swing end of the cover member 3 is caused to move in a direction in which the platen roller 7 comes to be spaced apart from the thermal head 6, so the storing portion 2*c* mounted to the case main body 2 is caused to be exposed.

Accordingly, the operator can readily set the roll-shaped heat sensitive paper 15 in the exposed storing portion 2*c*, that is, can readily and rapidly execute a recovering operation of a paper jam or a supplying operation of the heat sensitive paper 15.

Further, in a state where the roll-shaped heat sensitive paper 15 is stored in the storing portion 2*c* and a portion thereof is disposed so as to be along the printing surface 6*a* of the thermal head 6, by causing the cover member 3 to swing in a reverse direction, the upper portion opening 2*a* of the case main body 2 is closed with the cover member 3. In this case, the chamfers 12*a* of the engagement pieces 12 provided to the slider 8 come in contact with the case main body 2 to mount thereonto, so the coil springs 9 are compressed and the slider 8 is caused to move in the inward direction of the swing radius direction of the cover member 3.

Then, by further causing the cover member 3 to swing, the contact between the chamfers 12*a* of the engagement pieces 12 and the case main body 2 is released at the position where the platen roller 7 opposes to the thermal head 6, the elastically deformed coil springs 9 are decompressed, and the slider 8 is caused to move in the outward direction of the swing radius direction of the cover member 3. As a result, the engagement pieces 12 are completely engaged with the inside of the engagement concave portions 13, and the platen roller 7 provided to the slider 8 pressurizes the heat sensitive paper 15 in a state where the heat sensitive paper 15 is sandwiched between the platen roller 7 and the printing surface 6*a* of the thermal head 6.

In this case, according to the embodiment, the platen roller 7 pressurizes the heat sensitive paper 15 in the outward direction of the swing radius direction on the plane including the rotational center C1 of the platen roller 7 and the swing center C2 of the cover member 3, so a moment for causing the cover member 3 to swing due to the pressurizing force is not generated. Accordingly, the entire biasing force F due to the coil springs 9 can be effectively used to pressurize the heat sensitive paper 15 against the printing surface 6*a* of the thermal head 6.

As a result, rigidity of the coil springs 9 can be minimized, or the heat sensitive paper 15 can be brought into close contact with the printing surface 6*a* of the thermal head 6 with a large pressurizing force.

Further, according to the thermal printer 1 of the embodiment, the thermal head 6 is fixed to the side wall 2*b* of the case main body 2, so only the side wall 2*b* of the case main body 2 is disposed to a back surface side of the thermal head 6. Thus, a space in the back surface side of the thermal head 6 can be made smaller, and a width dimension thereof can be reduced, which are advantageous. Further, by fixing the thermal head 6 to the side wall 2*b* of the case main body 2, due to the side wall 2*b* of the case main body 2, rigidity of the thermal head 6 can be reinforced. As a result, the rigidity of the thermal head 6 itself is not necessarily large, and the thermal head 6 can be made thinner.

Further, the thermal head 6 is stiffly supported from its back surface by the side wall 2*b* of the case main body 2, so the biasing force F due to the coil springs 9 can be directly used without being released as the pressurizing force of the thermal head 6 with respect to the heat sensitive paper 15, which is advantageous.

Further, in the embodiment, the storing portion 2*c* for storing the roll-shaped heat sensitive paper 15 is provided to the inside of the substantially rectangular-parallelepiped box-shaped case 4 including the case main body 2 and the cover member 3 that close the case 4, so dead spaces S are defined in four corners thereof in the outward direction of a radius direction of the heat sensitive paper 15 as shown in FIG. 2. Further, in the embodiment, the thermal head 6 is fixed to an upper portion of the side wall 2*b* of the case main body 2, so the thermal head 6, the platen roller 7, the slider 8, the coil springs 9, and the like can be disposed so as to be stored in the dead spaces S. Thus, the thermal printer 1 can be structured to be more compact.

Note that in the embodiment, the coil springs 9 are exemplified as biasing means. However, it is not limited thereto, and an arbitrary elastic member may be employed alternatively. Further, the engagement pieces 12 and the engagement concave portions 13 engaged therewith are provided to the slider 8 and the case main body 2, respectively, or may be provided to the case main body 2 and the slider 8, respectively.

Further, in the embodiment, an example in which the case main body 2 is structured to have a rectangular-parallelepiped box shape is described, but the case main body 2 is not necessarily a rectangular parallelepiped, and any shape capable of storing the roll-shaped heat sensitive paper 15 can be employed.

What is claimed is:

1. A thermal printer, comprising:

a case main body;

a thermal head fixed to a side wall of the case main body;

a platen roller mounted for undergoing rotation about a rotational center thereof to feed heat sensitive paper, the platen roller confronting a printing surface of the thermal head so that the heat sensitive paper is fed between the platen roller and the thermal head;

a swing arm mounted to the case main body for undergoing swinging movement about a swing center of the swing arm;

a slider rotatably supporting the platen roller and mounted to a front end of the swing arm for undergoing linear movement on a plane including the rotational center of the platen roller and the swing center of the swing arm;

an engagement piece provided to one of the slider and the case main body;

an engagement concave portion provided to the other of the slider and the case main body for engagement with the engagement piece to hold the swing arm in a swing radius direction of the swing arm at a position where the platen roller confronts the printing surface of the thermal head;

a chamfer portion formed in one of the engagement piece and the engagement concave portion for causing the slider to move when the engagement concave portion engages the engagement piece; and biasing means for biasing the slider in an outward direction of the swing radius direction of the swing arm such that the engagement piece engages the engagement concave portion and the platen roller pressurizes the heat sensitive paper against the printing surface of the thermal head in a state in which the heat sensitive paper is fed between the platen roller and the printing surface of the thermal head.

2. A thermal printer according to claim 1; wherein the swing arm is provided with a lever for causing the slider to move in an inward direction of the swing radius direction against a biasing force of the biasing means.

3. A thermal printer according to claim 1; wherein the case main body has a rectangular-parallelepiped box shape and is provided with a storing portion for storing a roll-shaped heat sensitive paper; and wherein the thermal head is fixed to a side wall in an upper portion of the storing portion of the case main body.

4. A thermal printer according to claim 3; wherein the swing arm forms an upper cover portion of the storing portion.

* * * * *